US009796063B2

(12) United States Patent
Lefevre et al.

(10) Patent No.: US 9,796,063 B2
(45) Date of Patent: Oct. 24, 2017

(54) MULTI-LAYERED CHEMICAL-MECHANICAL PLANARIZATION PAD

(71) Applicant: FNS TECH CO., LTD., Cheonan-Si (KR)

(72) Inventors: Paul Lefevre, Topsfield, MA (US); Anoop Mathew, Peabody, MA (US); Guangwei Wu, Sunnyvale, CA (US); Scott Xin Qiao, Lexington, MA (US); Oscar K. Hsu, Chelmsford, MA (US); David Adam Wells, Hudson, NH (US); John Erik Aldeborgh, Boxford, MA (US); Marc C. Jin, Boston, MA (US)

(73) Assignee: FNS TECH CO., LTD., Cheonan-Si (KR)

( * ) Notice: Subject to any disclaimer, the term of this patent is extended or adjusted under 35 U.S.C. 154(b) by 615 days.

(21) Appl. No.: 14/318,894

(22) Filed: Jun. 30, 2014

(65) Prior Publication Data

US 2014/0311043 A1 Oct. 23, 2014

Related U.S. Application Data

(62) Division of application No. 12/652,143, filed on Jan. 5, 2010, now Pat. No. 8,790,165.

(Continued)

(51) Int. Cl.

| | |
|---|---|
| ***B24B 37/22*** | (2012.01) |
| ***B24D 3/34*** | (2006.01) |
| ***B24D 3/20*** | (2006.01) |

(52) U.S. Cl.

CPC ..... *B24B 37/22* (2013.01); *B24D 3/20* (2013.01); *B24D 3/34* (2013.01)

(58) Field of Classification Search

CPC ..... B24B 37/22; B24D 3/20; B24D 3/34

(Continued)

(56) References Cited

U.S. PATENT DOCUMENTS

| | | | | |
|---|---|---|---|---|
| 6,338,744 | B1 | 1/2002 | Tateyama et al. | |
| 7,086,932 | B2 * | 8/2006 | Vangsness | B24B 37/205 451/28 |

(Continued)

FOREIGN PATENT DOCUMENTS

| | | |
|---|---|---|
| EP | 1 418 021 | 5/2004 |
| JP | 2002-154040 | 5/2002 |

(Continued)

OTHER PUBLICATIONS

English translation of Office Action from corresponding Japanese Appln. No. 2011-544649 dated Jan. 28, 2014.

(Continued)

*Primary Examiner* — Robert Rose

(74) *Attorney, Agent, or Firm* — Grossman, Tucker, Perreault & Pfleger, PLLC

(57) ABSTRACT

The present disclosure relates to a chemical mechanical planarization pad and a method of making and using a chemical mechanical planarization pad. The chemical mechanical planarization pad may include a first component including a water soluble composition and water insoluble composition exhibiting a solubility in water of less than that of the water soluble composition, wherein at least one of the water soluble and water insoluble compositions of the first component is formed of fibers. The chemical mechanical planarization pad may also include a second component, wherein the first component is present as a discrete phase in a continuous of the second component.

13 Claims, 4 Drawing Sheets

Related U.S. Application Data

(60) Provisional application No. 61/142,544, filed on Jan. 5, 2009.

(58) Field of Classification Search
USPC ..... 451/526, 527, 533, 534, 532, 536, 41; 51/297–298
See application file for complete search history.

(56) References Cited

U.S. PATENT DOCUMENTS

| | | | |
|---|---|---|---|
| 2006/0116059 | A1 | 6/2006 | Chen et al. |
| 2006/0223424 | A1 | 10/2006 | Vangsness et al. |
| 2008/0146131 | A1 | 6/2008 | Vangsness et al. |

FOREIGN PATENT DOCUMENTS

| | | |
|---|---|---|
| JP | 2004-343090 | 12/2004 |
| JP | 2008-207325 | 9/2008 |
| TW | 486407 | 5/2002 |
| TW | I292730 | 6/2005 |
| TW | I279289 | 4/2007 |
| WO | 2007/001699 | 1/2007 |

OTHER PUBLICATIONS

Written Opinion from corresponding Singaporean Application No. 201104894-9 dated Oct. 10, 2012.
International Search Report and Written Opinion dated Mar. 9, 2010 issued in related International Patent Application No. PCT/US10/20081.

* cited by examiner

MULTI-LAYERED CHEMICAL-MECHANICAL PLANARIZATION PAD

CROSS-REFERENCE TO RELATED APPLICATIONS

The present application is a divisional application of U.S. application Ser. No. 12/652,143, filed Jan. 5, 2010 which claims the benefit of the filing date of U.S. Provisional Application No. 61/142,544, filed on Jan. 5, 2009, the teachings of which are incorporated herein by reference.

FIELD

The present disclosure relates to polishing pads useful in Chemical-Mechanical Planarization (CMP) of semiconductor wafers and other surfaces such as bare substrate silicon wafers, CRT, flat panel display screens and optical glass.

BACKGROUND

In semiconductor wafer polishing, the advent of very large scale integration (VLSI) and ultra large scale integration (ULSI) circuits has resulted in the packing of relatively more devices in smaller areas on a semiconductor substrate, which may necessitate greater degrees of planarity for the higher resolution lithographic processes that may be required to enable said dense packing. In addition, as copper and other relatively soft metals and/or alloys are increasingly being used as interconnects due to their relatively low resistance, the ability of the CMP pad to yield relatively high planarity of polish without significant scratching defects on the soft metal surface may become relatively critical for the production of advanced semiconductors. High planarity of polish may require a hard and rigid pad surface to reduce local compliance to the substrate surface being polish. However, a relatively hard and rigid pad surface may tend to also cause scratching defects on the same substrate surface thus reducing production yield of the substrate being polished.

SUMMARY

An aspect of the present disclosure relates to a chemical mechanical planarization pad. The chemical mechanical planarization pad may include a first component including a water soluble composition and water insoluble composition exhibiting a solubility in water of less than that of the water soluble composition, wherein at least one of the water soluble and water insoluble compositions of the first component is formed of fibers. The chemical mechanical planarization pad may also include a second component, wherein the first component is present as a discrete phase in a continuous of the second component and the water soluble composition may provide pores having a size in the range of 10 nanometers to 200 micrometers upon dissolution.

Another aspect of the present disclosure relates to a method of forming a chemical mechanical planarization pad, such as the above pad. The method may include forming a first component including a water soluble material and a water insoluble material, wherein at least one of the water soluble material and the water insoluble material is formed of fibers. The method may also include embedding the first component as discrete phases in a continuous phase of a second component, wherein the water soluble composition may provide pores having a size in the range of 10 nanometers to 200 micrometers upon dissolution.

A further aspect of the present disclosure relates to a method of polishing a substrate. The method may include contacting a substrate with a slurry and a chemical mechanical planarization pad, such as the above mechanical planarization pad. The chemical mechanical planarization pad may include a first component including a water soluble composition and water insoluble composition exhibiting a solubility in the slurry of less than that of the water soluble composition and at least one of the water soluble and water insoluble compositions of the first component is formed of fibers. The chemical mechanical planarization pad may also include a second component, wherein the first component is present as a discrete phase in a matrix of the second component and the water soluble composition may provide pores having a size in the range of 10 nanometers to 200 micrometers upon dissolution.

BRIEF DESCRIPTION OF DRAWINGS

The above-mentioned and other features of this disclosure, and the manner of attaining them, may become more apparent and better understood by reference to the following description of embodiments described herein taken in conjunction with the accompanying drawings, wherein.

DETAILED DESCRIPTION

Figure 2:
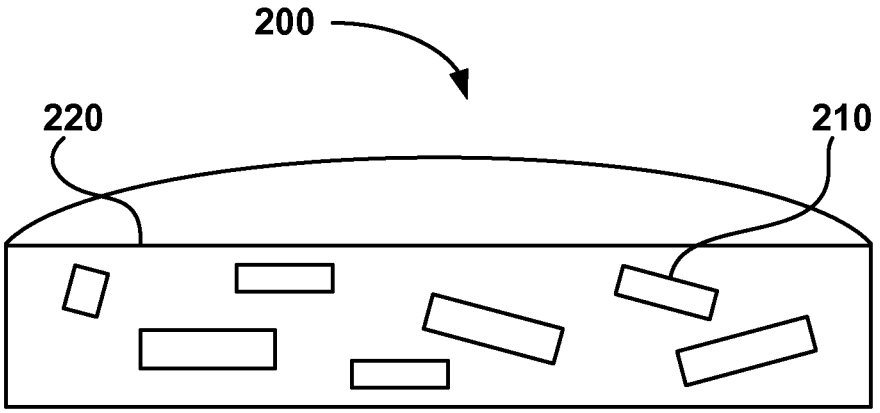
FIG. 2 illustrates a cross-section of an example of a chemical-mechanical planarization pad.

The present disclosure relates to a product, method of making and use of a polishing pad particularly useful for the Chemical Mechanical Planarization (CMP) of semiconductor wafer substrates where a high degree of planarity and low scratching defect may be critical. As generally illustrated in FIG. 2 and discussed further below, the CMP pad 200 may include a first discrete phase or component 210 comprising two or more compositions each exhibiting a different water solubility, and a second continuous phase or component 220 comprising one polymeric substances or a miscible mixture of two or more polymeric substances, such that the first and second components are combined in the pad at various ratios and configurations, as disclosed herein. In addition, reference to a miscible mixture of two or more polymer components for the second component may be understood as that situation where the two polymeric substances may combine and provide a continuous phase to contain the first component as the discrete phase.

In one embodiment, the first component may include both a water soluble material and a water insoluble material, either or both of which may be in fiber form. In some embodiments, the water insoluble material may always be in fiber form. Water solubility herein may be understood as the ability of a given substance to at least partially dissolve in water. For example, the substance may have solubility in water of 30 to 100 parts per 100 parts water, including all values and increments therein, and dissolution time from 5 to over 60 seconds, including all values and increments therein. In other words, the substance may at least partially dissolve in water at room temperature or at elevated temperatures and/or upon exposure pressure or mechanical action over a period of a few seconds to 360 minutes, including all values and increments therein. Such water solubility may be achieved in a chemical mechanical planarization process where one may use an aqueous based slurry, as described further below. The water soluble material of the first component may include one or more of the following: poly (vinyl alcohol), poly (acrylic acid), maleic acid, alginates, polysaccharides, poly cyclodextrins, as well as salts, copolymers and/or derivatives thereof. Water insoluble materials of the first component may include one or more water insoluble substance such as polyester, polyamide, polyolefin, rayon, polyimide, polyphenyl sulfide, etc., including combinations thereof. The water insoluble substance herein may therefore be understood as a substance that has a water solubility that is less than the water soluble substance noted above. For example, it may have a water solubility that is less than or equal to about 10 parts per 100 parts water.

The water soluble material of the first discrete component may have one or more of the following physical properties: density 0.3 to 1.3 gm/cc, including all values and increments therein, and Durometer hardness of 10 Shore A to over 60 Shore D, including all values and increments therein. Similarly, the water insoluble material of the first discrete component may have one or more of the following physical properties: density 0.3 to 1.3 gm/cc., including all values and increments therein, and Durometer hardness of 10 Shore A to over 80 Shore D, including all values and increments therein. As may be appreciated, in various examples, the hardness of the water insoluble material may be greater than, equal to or less than that of the soluble material.

Figure 1A:
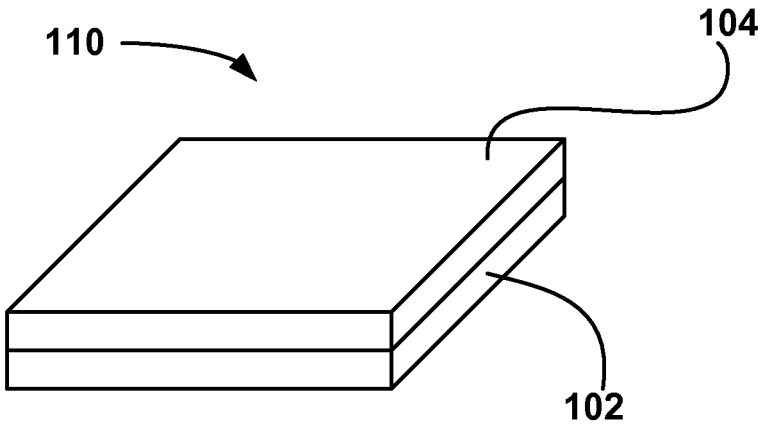
FIG. 1*a* illustrates an example of a first component including a water soluble and water insoluble material arranged as layers, wherein the layers may include fabric.
Figure 1B:
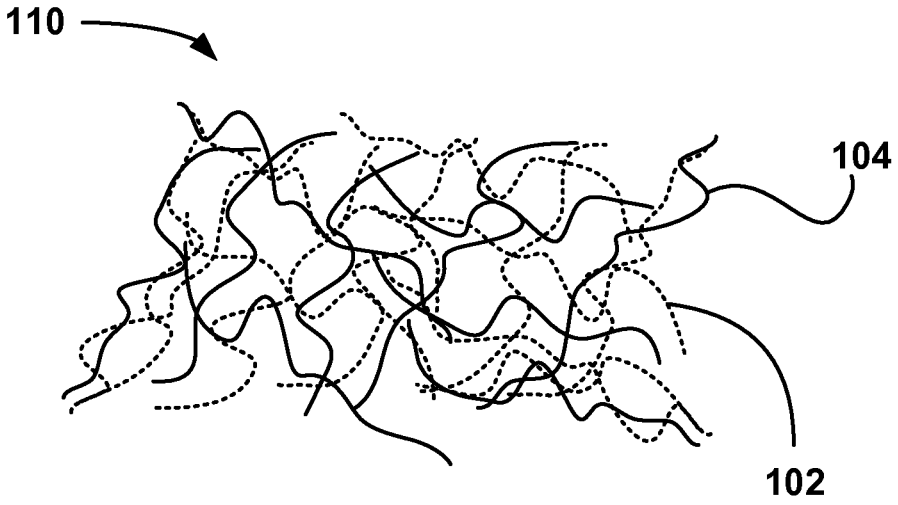
FIG. 1*b* illustrates an example of a first component including a water soluble and a water insoluble material combined to form a fabric.
Figure 1C:
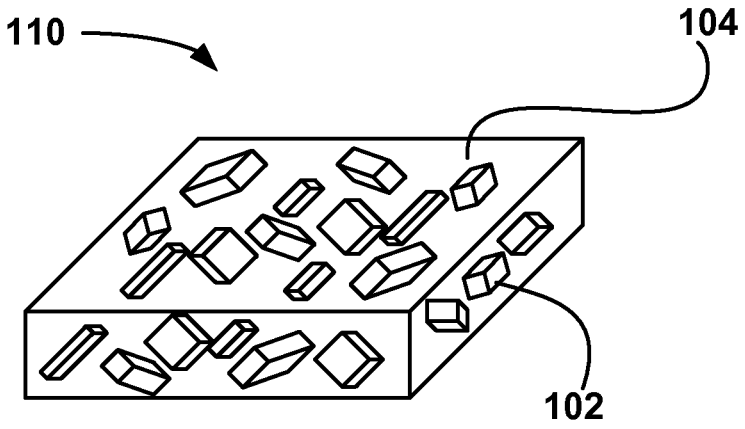
FIG. 1*c* illustrates an example of a first component including a water soluble material in the form of a particle dispersed in a matrix of a water insoluble material, which may include fibers.

In some examples, the first component 110, an example of which is illustrated in FIG. 1*a*, may include a first layer 102 of water soluble nonwoven fabric stacked onto a second layer 104 of a water insoluble nonwoven fabric formed of the materials described above. In other examples, the first component 110, illustrated in FIG. 1*b*, may specifically include a nonwoven fabric including a relatively homogenous mixture of water soluble 102 and insoluble 104 fibers formed of the materials described above. In addition, in other examples, the first component may also be a woven or knit material. In further examples, illustrated in FIG. 1*c*, the first component 110 may include water soluble particles 102, again formed of the materials described above. The water soluble particles may be embedded in the water insoluble material 104 or otherwise combined with the water insoluble materials. Furthermore, the water soluble particles may replace all or a part of the water soluble fabric. That is, the layer 102 of water soluble material may include both water soluble fibers in combination with water soluble particles.

With respect to the first component, the water soluble material 102 may be present with the water insoluble material 104 in the range of 0.01% to 99.99% by weight of the combination of the water soluble and water insoluble materials, such as in the range of 0.2% by weight to 0.8% by weight. Thus, the water insoluble material may be present in the range of 0.01% to 99.99% by weight of the combination of the water soluble and water insoluble material. Furthermore, the first component may be present in the range of 0.01% to 99.99% by weight of the combination of the first and second components, such as in the range of 0.3% to 0.7% by weight.

The second component 220 serves as the continuous phase for the first component 210, which is present as a discrete phase. As therefore illustrated in FIG. 2, the first component 210 may be dispersed relatively uniformly in the second component 220. This may be understood as that situation where a relatively similar weight or volume of the first component may be present throughout the second component. In other embodiments, the first component may be distributed in the continuous phase of the second component along various gradients throughout the pad, or in a manner such that the first component is selectively provided near a given surface, such as the polishing surface, of the pad. In that regard, the second component may be considered as the continuous phase, with the first component dispersed therein.

The second component 220 may include a single polymeric substance such as polyurethane, or, as noted above, a miscible mixture of two or more polymeric substances such as polyurethane having different physical and chemical properties, which are also water insoluble. Again, miscibility may be understood as a relatively homogenous mixture, providing a continuous phase, wherein discrete phases of the polymeric substances forming the second component may be present at levels of 25% by weight or less of the second component, including all values and increments in the range of 0% to 25%, such as 0.1% to 24.9%, etc.

Accordingly, the second component may include one or more polyurethanes. Polyurethane substances suitable for forming the second component may include, but are not limited to, pre-polymers of polyurethane reacted with curatives, polyurethane resins used for injection, extrusion, blow molding or RIM operations, as well as various solvent and/or water based solutions and dispersions of polyurethane. The polishing pad matrix may also include or consist of other thermoplastic or thermoset polymers, such as polycarbonate, polysulfone, polyphenylene sulfide, epoxy, various polyesters, polyimides, polyamides, polyolefins, polyacrylates, polymethylmethacrylates, polyvinyl chlorides, polyvinyl alcohols and/or derivatives of or copolymers of the above.

It may be appreciated that where more than one polymeric substance forming the second component is present, a first polymeric substance forming the second component may be present in the range of 1% to 99% by weight and the second polymeric substance may be present in the range of 99% by weight to 1% by weight. Furthermore, a third polymeric substance forming the second component may be present in the range of 1% to 98% by weight of the second component, including all values and increments therein. Accordingly, for example, a first polymeric substance may be present in the range of 25% to 90% by weight of the second component and a second polymeric substance may be present in the range of 10% to 75% by weight of the second component. In another example, a first polymeric substance may be present in the range of 5 to 90% by weight of the second component, a second polymeric substance may be present in the range of 5% to 75% by weight of the second component and a third polymeric substance may be present in the range of 5% to 90% by weight of the second component.

The second component may have one or more of the following physical properties density 0.3 to 1.2 gm/cc, Durometer Hardness 30 Shore A to 90 Shore D, and compression modulus of 10 to over 500 megapascal. It may be appreciated that, in some examples, the second component may have a hardness that is greater than that of the water insoluble material of the first component. It may be appreciated that the difference in hardness may be in the range of 1 unit to 70 units of shore hardness along a given scale of hardness, including all values and increments therein, such as 1 unit of shore hardness, 10 units of shore hardness, 50 units of shore hardness, etc. Furthermore, it may be appreciated that upon transitioning of hardness scales (from A to D), the unit number itself may not be greater; however, the hardness may remain greater, e.g., a Durometer Hardness of 10 Shore D may be greater than a hardness of 30 Shore A. In other examples, the second component may have a hardness that is less than that of the water insoluble material of the first component. Again, it may be appreciated that the difference in hardness may be in the range of 1 unit to 70 units of shore hardness along a given scale of hardness, including all values and increments therein, such as 1 unit of shore hardness, 10 units of shore hardness, 50 units of shore hardness, etc. In further examples, the second component may have a hardness that is equal to that of the water insoluble material of the first component.

Given the above, it may be appreciated that upon dissolution of the water soluble material, pores will then be formed within the continuous phase of the pad. Such pores may have a size of 10 nanometers to over 100 micrometers, including all values and increments in the range of 10 nanometers to 200 micrometers, 10 nanometers to 100 nanometers, 1 micrometer to 100 micrometers, etc. This porosity is now selectively formed at a location where there is also a selected presence of a water insoluble material. That being the case, the polishing pad of the present disclosure allows for the formation of pores through the dissolution of the water soluble material. The pores are then proximate to a selected water insoluble material within the pad that may provide regions of selected physical properties immediately adjacent the pore and/or defining at least a portion of the pore surface. This may then provide for improved pore stability in an ensuing polishing operation. For example, the polishing slurry may enter the pore and be retained by the water insoluble material. In addition, where particles may be present in the slurry, the particles may migrate into and be captured by the selected water insoluble material, forming a portion of the boundary of the pore. Furthermore, where particles are discharged from the substrate being polished, the particles may also be entrapped and retained by the water insoluble material within the pores. Finally, upon exposure, the water insoluble material may, in some embodiments, provide different physical properties from those present in the second component, i.e., the continuous phase, of the polishing pad.

In manufacturing a CMP pad of this embodiment, to form the first component, a water soluble material may be placed next to, intermingled with, dispersed within or otherwise combined with the insoluble material. In some examples, the water soluble material may constitute the outer layer or surface of the pad, which may be in contact with the substrate during polishing. Both soluble and insoluble materials of the first component may optionally be conditioned under controlled temperature and humidity. For example, the soluble and insoluble materials of the first component may be dried, removing residual surface moisture. Drying may occur at temperatures in the range of, for example, 37° C. to 150° C., including all values and increments therein. Furthermore, drying may occur over a few minutes to over 60 hours, including all values and increments therein. The second component may then be introduced to the first component in a manner as to partially or completely fill or embed the first component.

In some embodiments, at least a portion of the water soluble material may be subsequently removed by exposing the CMP pad to water or an aqueous solution with or without chemical, thermal, and/or mechanical means such as ultrasonics, accelerating removal of the water soluble component. Alternately, the water soluble material may be removed progressively during CMP as the pad is exposed to the water based abrasive slurry. Again, it may be appreciated that dissolution of the water soluble material may lead to exposure of water insoluble material present in the discrete phases of the first component.

Figure 3:
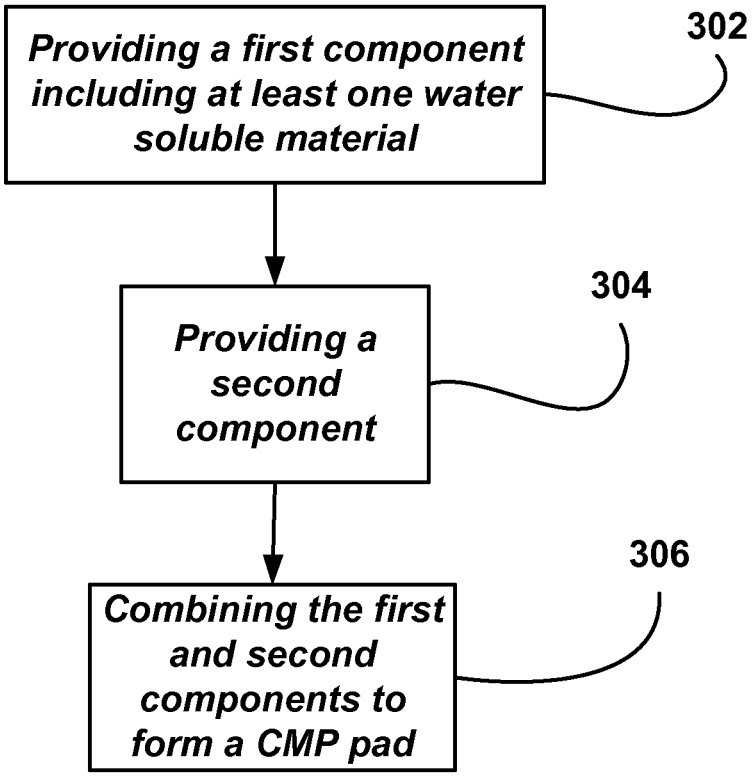
FIG. 3 illustrates a flow diagram of an example of a method of forming a chemical mechanical planarization pad.

Generally of a method of making a polishing pad for Chemical Mechanical Planarization (CMP) of microelectronic devices and semiconductor wafers may therefore be contemplated herein as illustrated in FIG. 3. The method may include or consist of providing at 302 a first component that includes at least two layers or two materials, one of which contains at least one water soluble material and at least one of which includes a fiber. The method may also include or consist of providing at 304 a second component comprising a homogeneous mixture of substance(s), such as a mixture of polyurethanes, and combining the first and second components in various ratios and configurations 306, wherein the first component forms discrete phases in the continuous second component. A CMP pad may then be formed where the first component may, in some embodiments, be dispersed relatively uniformly in the second component.

In one example of forming the polishing pad, the first component, containing at least two materials, one of which is water soluble, may be placed into a mold and the second component may be poured as a polymer precursor into the mold. Pressure and/or heat may then be applied to the mold to facilitate the curing (e.g. polymerization and/or crosslinking) of the polymer precursor. In another example, the first component may be combined with the second component, wherein the second component may be in a melt state and injected or otherwise transferred into a mold. A melt state may be understood as a state where the viscosity may be sufficiently low enough to allow flow of the second component upon the application of pressure. The second component may be allowed to solidify, wherein the viscosity may be sufficiently high enough to form a relatively solidified and/or self supporting part.

Figure 4:
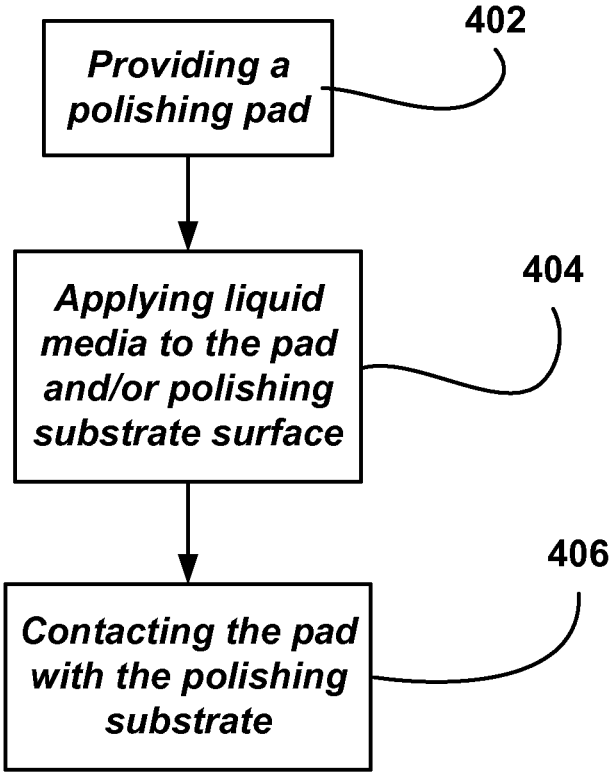
FIG. 4 illustrates a flow diagram of an example of a method of using a chemical mechanical planarization pad.

Also contemplated herein is an example of a method of using a polishing pad for Chemical Mechanical Planarization (CMP) of a substrate surface, as illustrated in FIG. 4. The substrate may include microelectronic devices and semiconductor wafers, including relatively soft materials, such as metals, metal alloys, ceramics or glass. In particular, the materials to be polished may exhibit a Rockwell (Rc) B hardness of less than 100, including all values and increments in the range of 0 to 100 Rc B as measured by ASTM E18-07. Other substrates to which the polishing pad may be applied may include, for example, optical glass, cathode ray tubes, flat panel display screens, etc., in which, scratching or abrasion of the surface may be desirably avoided. A pad may be provided including, for example, (1) a first component comprising two or more layers, at least one of said layers is water soluble, and (2) a second component comprising a homogeneous mixture of substances, such that the first and second components are combined in said pad in various ratios and configurations 402. The pad may then be utilized in combination with liquid media, such as an aqueous media, with or without abrasive particles. For example, the liquid media may be applied to a surface of the pad and/or the substrate to be polished 404. The pad may then be brought into close proximity of the substrate and then applied to the substrate during polishing 406. It may be appreciated that the pad may be attached to equipment used for Chemical Mechanical Planarization for polishing.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A method of forming a chemical mechanical planarization pad comprising:

forming a first component comprising a first fabric layer layered on a second fabric layer, wherein the first fabric layer includes a water soluble composition comprising a first fiber and the second fabric layer includes a water insoluble composition comprising a second fiber; and embedding said first component as discrete phases in a continuous phase of a second component, wherein said water soluble composition provides pores having a size in the range of 10 nanometers to 200 micrometers upon dissolution.

2. The method of claim 1, further comprising:

removing at least a portion of said water soluble material embedded in said second component.

3. The method of claim 1, wherein said first fabric layer is in the form of a nonwoven fabric, woven fabric, or knit fabric, and the second fabric layer is in the form of a nonwoven fabric, woven fabric, or knit fabric.

4. The method of claim 3, wherein said first fabric layer is a nonwoven fabric.

5. The method of claim 1, wherein said water soluble composition comprises water soluble particles and said water insoluble composition comprises a matrix in which said water soluble particles are embedded.

6. The method of claim 1, further comprising placing said first component into a mold and pouring a precursor of said second component into said mold and reacting said precursor to embed said first component in said second component.

7. The method of claim 1, further comprising placing said first component into a mold; melting said second component; and disposing said second component in said mold to embed said first component in said second component.

8. The method of claim 1, wherein said second component includes at least two miscible water insoluble materials.

9. The method of claim 1, wherein said water soluble composition comprises one or more materials selected from the group consisting of poly (vinyl alcohol), poly (acrylic acid), maleic acid, alginates, polysaccharides, poly cyclodextrins, as well as salts, copolymers and/or derivatives thereof.

10. The method of claim 1, wherein said water insoluble composition comprises one or more materials selected from the group consisting of polyester, polyamide, polyolefin, rayon, polyimide, polyphenyl sulfide and combinations thereof.

11. The method of claim 1, wherein said second component includes one or more materials selected from the group consisting of polycarbonate, polysulfone, polyphenylene sulfide, epoxy, various polyesters, polyimides, polyamides, polyolefins, polyacrylates, polymethylmethacrylates, polyvinyl chlorides, polyvinyl alcohols, derivatives thereof and copolymers thereof.

12. The method of claim 1, wherein said second component includes at least two miscible water insoluble materials.

13. The method of claim 1, wherein said water insoluble composition exhibits a Durometer hardness of 10 Shore A to over 80 Shore D and said second composition exhibits a Durometer hardness of 30 Shore A to over 80 Shore D.

* * * * *